US011289288B2

(12) United States Patent
Lai et al.

(10) Patent No.: US 11,289,288 B2
(45) Date of Patent: Mar. 29, 2022

(54) WATERPROOF FILM AND KEYBOARD THEREOF

(71) Applicant: DARFON ELECTRONICS CORP., Taoyuan (TW)

(72) Inventors: Zheng-Hong Lai, Taoyuan (TW); Chih-Ho Hsu, Taoyuan (TW); Chin-Lung Chan, Taoyuan (TW); Che-Wei Lee, Taoyuan (TW); Chang-En Sun, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/103,911

(22) Filed: Nov. 24, 2020

(65) Prior Publication Data

US 2021/0193411 A1 Jun. 24, 2021

(30) Foreign Application Priority Data

Dec. 23, 2019 (TW) ..... 108147189

(51) Int. Cl.
*H01H 13/86* (2006.01)
*H01H 13/83* (2006.01)

(52) U.S. Cl.
CPC ..... *H01H 13/86* (2013.01); *H01H 13/83* (2013.01); *H01H 2233/07* (2013.01)

(58) Field of Classification Search
CPC ..... H01H 13/86; H01H 13/83; H01H 13/06
USPC ..... 200/5 A, 341
See application file for complete search history.

(56) References Cited

U.S. PATENT DOCUMENTS

2017/0178840 A1* 6/2017 Hegde ..... G06F 3/0202
2018/0323021 A1* 11/2018 Lai ..... H01H 13/86

FOREIGN PATENT DOCUMENTS

CN 101856923 * 10/2010 ..... B41M 3/12
TW 201843688 A 12/2018
TW I667678 B 8/2019
WO 2019/023357 A1 1/2019

* cited by examiner

*Primary Examiner* — Edwin A. Leon
*Assistant Examiner* — Iman Malakooti
(74) *Attorney, Agent, or Firm* — Winston Hsu

(57) ABSTRACT

A waterproof film includes a film reinforcing layer, a light shielding layer, a texture layer, and a pattern. The light shielding layer is combined under the film reinforcing layer and forms a plurality of protruding structures cooperatively with the film reinforcing layer by a hot pressing process. The texture layer is attached to a release film and then formed on a top surface and a side surface of each protruding structure after a hot pressing process is performed and the release film is then peeled. The pattern is formed on the texture layer or the light shielding layer.

15 Claims, 6 Drawing Sheets

WATERPROOF FILM AND KEYBOARD THEREOF

BACKGROUND OF THE INVENTION

1. Field of the Invention

The present invention relates to a waterproof film and a keyboard thereof, and more specifically, to a waterproof film having a film reinforcing layer and a keyboard thereof.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

In practical application, for preventing foreign bodies (e.g. water or dust) entering the keyboard through a gap between keyswitches on the keyboard to cause damage of the keyboard, the prior art involves covering a protection film on the keyswitches for generating the waterproof and dustproof effects. However, in the prior art design, the protection film is usually required to increase its thickness for improving the overall film strength of the protection film, so as to cause the problem that the protection film has a poor pressing feedback and the keyswitches are not easy to press due to the excessive thickness of the protection film. Furthermore, since the prior art usually adopts an inkjet printing process to form patterns on the protection film, it may cause another problem that the patterns can be only formed on a top surface of the protection film, so as to influence the external appearance integrity of the protection film. Moreover, the patterns formed by the inkjet process are worn easily over a long period of time and then illegible.

SUMMARY OF THE INVENTION

The present invention provides a waterproof film including a film reinforcing layer, a light shielding layer, a texture layer, and a pattern. The light shielding layer is combined under the film reinforcing layer to form a plurality of protruding structures cooperatively with the film reinforcing layer by a hot pressing process. The texture layer is attached to a release film and then formed on a top surface and a side surface of each protruding structure after a hot pressing process is performed and the release film is then peeled. The pattern is formed on the texture layer or the light shielding layer.

The present invention further provides a keyboard including a bottom board, a plurality of keyswitches, and a waterproof film. The plurality of keyswitches is disposed on the bottom board. Each keyswitch includes a keycap and a lifting mechanism. The lifting mechanism is disposed between the bottom board and the keycap. The keycap is movable upward and downward relative to the bottom board via the lifting mechanism. The waterproof film covers the plurality of keyswitches. The waterproof film includes a film reinforcing layer, a light shielding layer, a texture layer, and a pattern. The light shielding layer is combined under the film reinforcing layer to form a plurality of protruding structures cooperatively with the film reinforcing layer by a hot pressing process for covering each keycap. The texture layer is attached to a release film and then formed on a top surface and a side surface of each protruding structure after a hot pressing process is performed and the release film is then peeled. The pattern is formed on the texture layer or the light shielding layer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
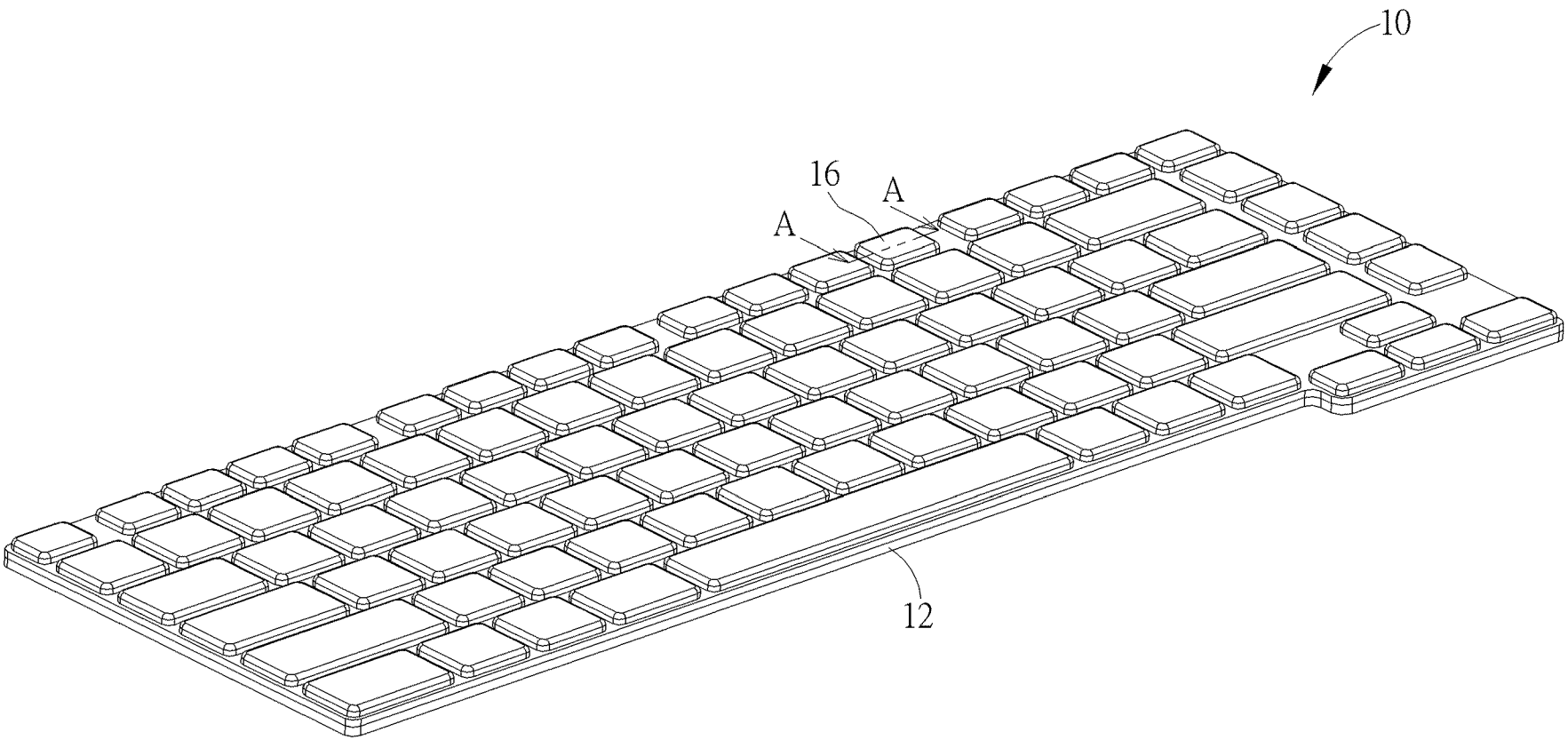
FIG. 1 is a diagram of a keyboard according to an embodiment of the present invention.
Figure 2:
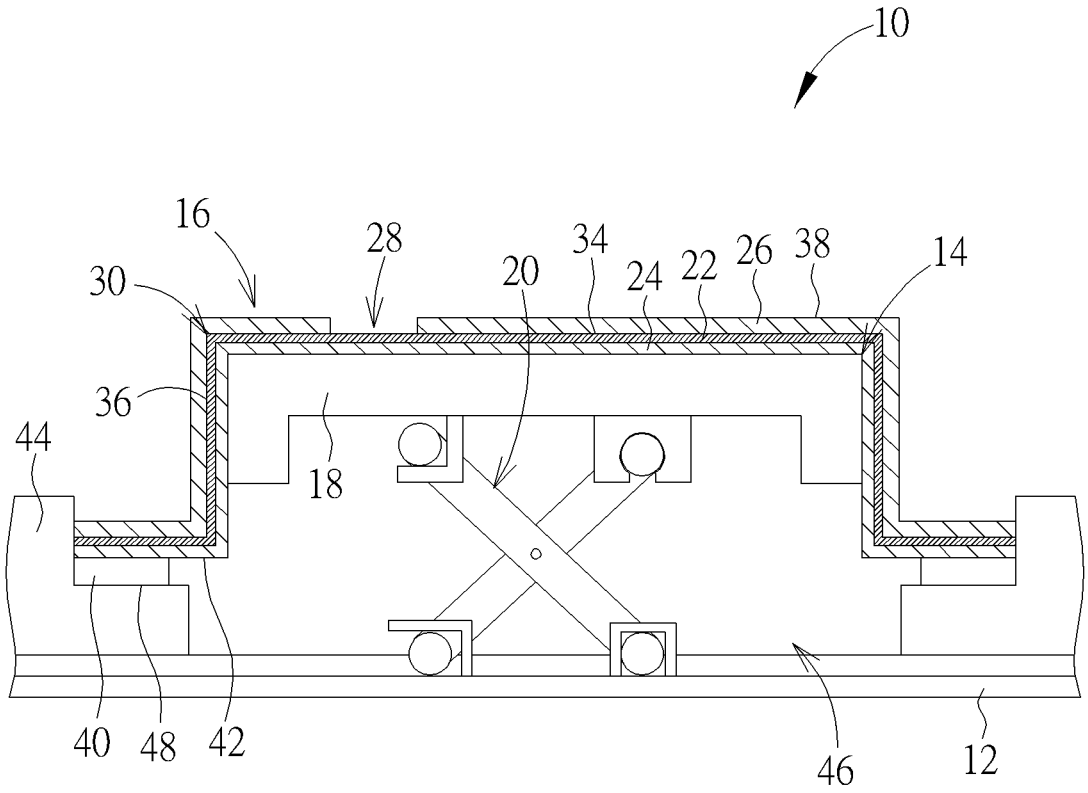
FIG. 2 is a cross-sectional diagram of the keyboard in FIG. 1 along a cross-sectional line A-A.

Please refer to FIG. 1 and FIG. 2. FIG. 1 is a diagram of a keyboard 10 according to an embodiment of the present invention. FIG. 2 is a cross-sectional diagram of the keyboard 10 in FIG. 1 along a cross-sectional line A-A. As shown in FIG. 1 and FIG. 2, the keyboard 10 includes a bottom board 12, a plurality of keyswitches 14, and a waterproof film 16. The plurality of keyswitches 14 is disposed on the bottom board 12 for a user to press to execute a desired input function. To be noted, the keyboard 10 could preferably have a light emitting function (the related description for the light emitting design is commonly seen in the prior art and omitted herein) and could be applied to a portable electronic device with a foldable mechanism composed of an upper cover and a lower casing (e.g. a notebook or a foldable keyboard, but not limited thereto). Each keyswitch 14 includes a keycap 18 and a lifting mechanism 20. The lifting mechanism 20 is disposed between the bottom board 12 and the keycap 18 and preferably adopts a scissor support design commonly applied to a keyswitch of a keyboard (but not limited thereto, meaning that the present invention could adopt other support design, such as a butterfly support design, a magnetic support design, etc.). Accordingly, the keycap 18 can be movable upward and downward relative to the bottom board 12 via the lifting mechanism 20.

Furthermore, as shown in FIG. 2, the waterproof film 16 covers the keyswitches 14 and includes a film reinforcing layer 22, a light shielding layer 24, a texture layer 26, and a pattern 28. The light shielding layer 24 is preferably made of silicone material (but not limited thereto, meaning that the present invention could adopt other common shielding layer material, such as polyurethane (PU) material). The film reinforcing layer 22 can be used to improve the overall film strength of the waterproof film 16 for efficiently preventing the waterproof film 16 from being broken by pulling. The film reinforcing layer 22 could be a fabric layer (e.g. a non-woven or braided layer with a low cost) or could be made of natural fiber (e.g. cotton, linen, silk, etc.) or synthetic fiber (e.g. polyester, nylon, spandex, etc.) material. The fabric layer preferably has a denier from 15 to 100 (but not limited thereto). To be noted, the present invention could adopt other reinforcing material design to improve the film strength. For example, in another embodiment, the film reinforcing layer could be a polymer film layer made of polymer material (e.g. thermoplastic polyurethane (TPU) material).

Figure 3:
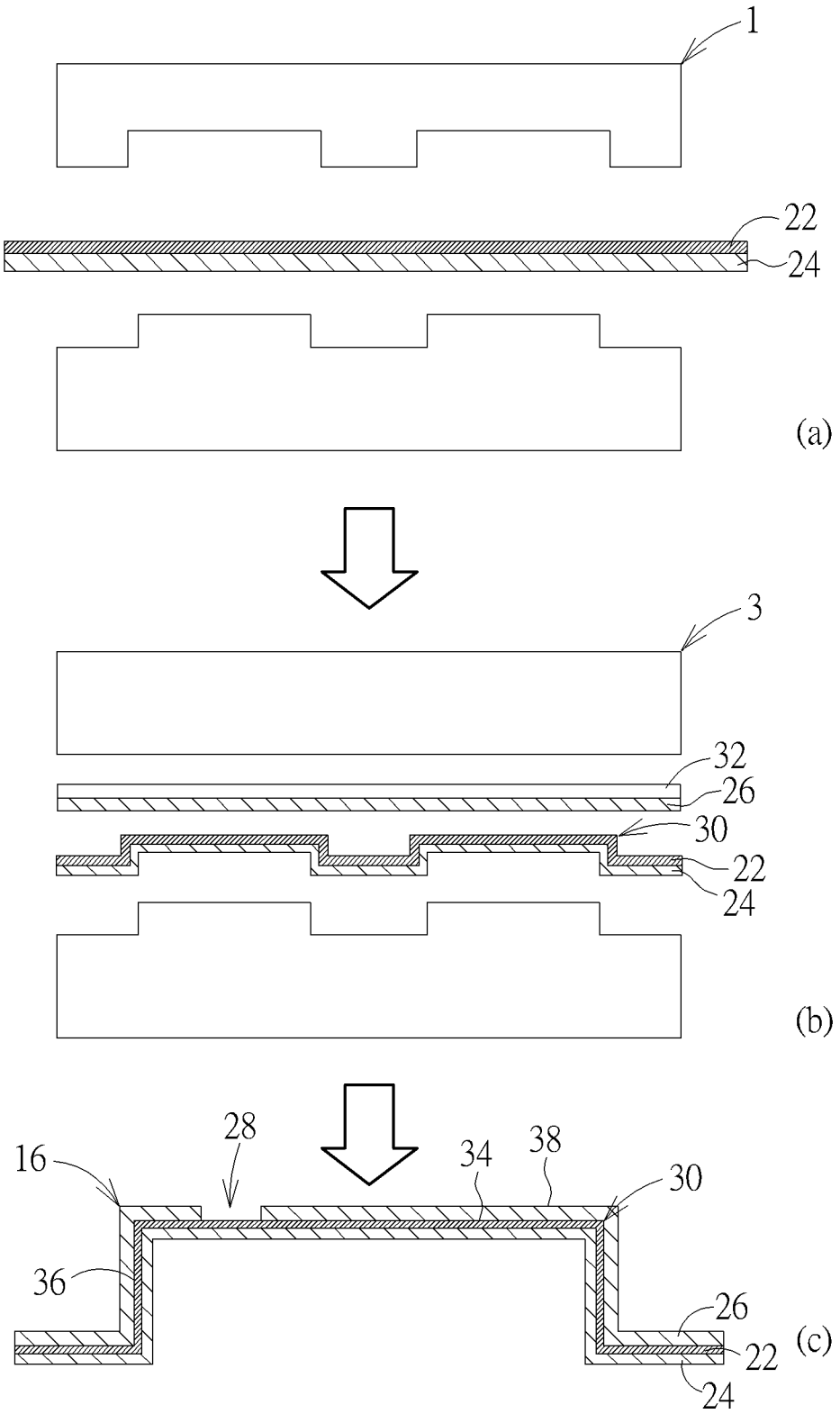
FIG. 3 is a process diagram of the waterproof film in FIG. 2.

More detailed description for the connection process of one keyswitch 14 and the waterproof film 16 is provided as follows. As for the related description for connection of the other keyswitches 14 and the waterproof film 16, it could be reasoned by analogy according to the following description and omitted herein. Please refer to FIG. 2 and FIG. 3. FIG. 3 is a process diagram of the waterproof film 16 in FIG. 2. First, the light shielding layer 24 can be coated under the film reinforcing layer 22, and then the film reinforcing layer 22 with the light shielding layer 24 coated thereon can be disposed in a mold 1 (as shown in FIG. 3(*a*)). Subsequently, the mold 1 can be utilized to perform a hot pressing process on the film reinforcing layer 22 and the light shielding layer 24, so that the light shielding layer 24 and the film reinforcing layer 22 can form a plurality of protruding structures 30 cooperatively by the hot pressing process for covering the keycaps 18. As for the related description for the hot pressing process, it is commonly seen in the prior art and omitted herein.

Subsequently, the texture layer 26 attached on a release film 32 can be placed between a mold 3 and the film reinforcing layer 22 hot-pressed together with the light shielding layer 24 (as shown in FIG. 3 (*b*)), and the mold 3 is utilized to perform a hot pressing process on the film reinforcing layer 22, the light shielding layer 24, and the texture layer 26 attached on the release film 32. For example, the texture layer 26 and the release film 32 could be softened first by a one-stage hot pre-adhering process, and then a two-stage hot stretching process is performed to ensure that the texture layer 26 can be fitted onto the protruding structure 30 perfectly. After the release film 32 is peeled from the texture layer 26, the texture layer 26 can be formed on a top surface 34 and a side surface 36 of the protruding structure 30 accordingly.

Finally, the pattern 28 (e.g. a symbol, a number, etc.) can be formed on the texture layer 26 (as shown in FIG. 3 (*c*)) by performing a pattern forming process (preferably a laser engraving process, but not limited thereto) on the top surface 38 of the texture layer 26, so as to form the waterproof film 16. After the formed waterproof film 16 is attached to the keycap 18 (e.g. by glue, but not limited thereto), the connection process of the keyswitch 14 and the waterproof film 16 is completed (as shown in FIG. 2), so that the keyboard 10 can have a film protection function for generating the waterproof and dustproof effects.

In summary, via the design that the film reinforcing film is utilized to improve the film strength of the waterproof film and the texture layer is formed on the top surface and the side surface of the protruding structure by a hot pressing process, the present invention can solve the prior art problem that the protection film has a poor pressing feedback due to the excessive thickness of the protection film and the patterns can be only formed on the top surface of the protection film, so as to be advantageous to the thinning design of the waterproof keyboard and improve the external appearance integrity of the waterproof film in the pattern design. Furthermore, since the present invention adopts the design that the texture layer is formed on the waterproof film by the hot pressing process, the present invention can also solve the prior art problem that the texture pattern formed by the inkjet printing process is not wear-resistant, so as to extend the service life of the waterproof film.

In practical application, as shown in FIG. 2, the waterproof film 16 could further include a waterproof spacer layer 40. The waterproof spacer layer 40 could be formed on a bottom periphery 42 of each protruding structure 30. The keyboard 10 could further include a keyboard frame 44. The keyboard frame 44 is disposed on the bottom board 12 and has a plurality of hole structures 46 corresponding to the plurality of keyswitches 14. Each keyswitch 14 is disposed through the corresponding hole structure 46. The waterproof spacer layer 40 is attached to a support surface 48 extending outward from a hole edge of each hole structure 46 for connecting the waterproof film 16 to the keyboard frame 44, so as to prevent foreign bodies (e.g. water or dust) from entering the keyswitch 14 through a gap between waterproof film 16 and the keyboard frame 44 to cause damage of the keyswitch 14. Furthermore, the aforesaid connection design can efficiently enhance the flatness of the waterproof film 16 on the keyboard 10 and make the waterproof film 16 attached to the keyboard frame 44 more precisely and steadily, so as to improve the assembly convenience of the waterproof film 16.

Figure 4:
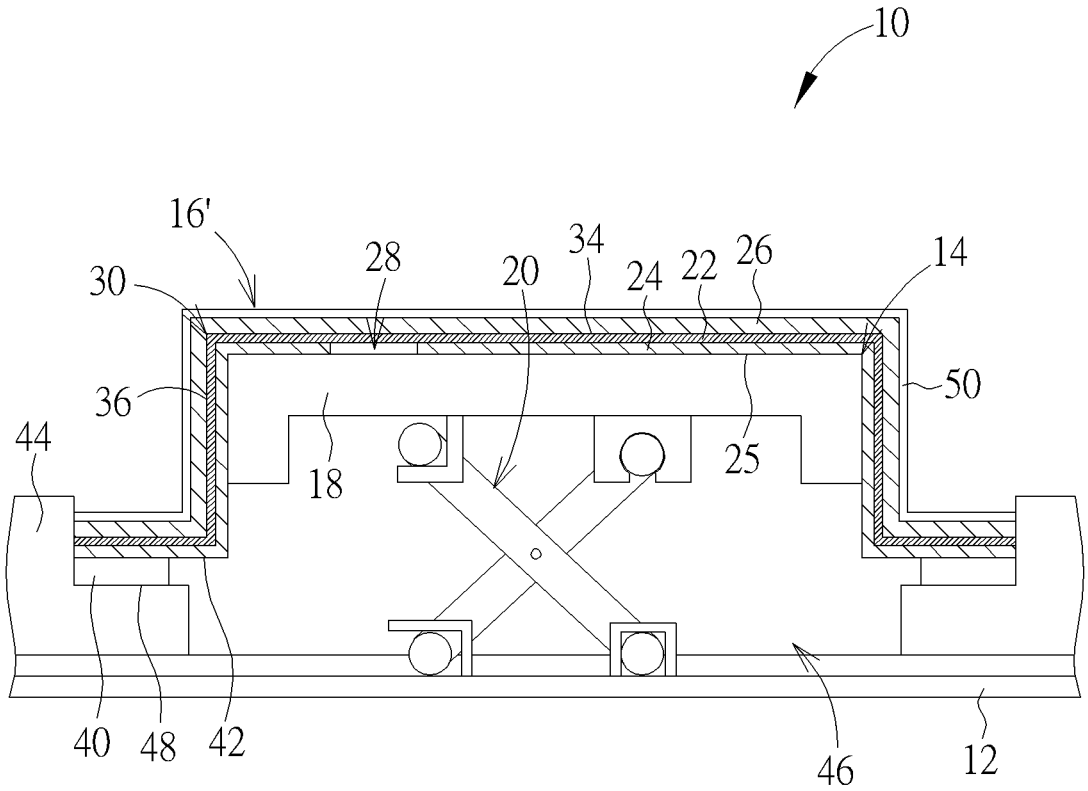
FIG. 4 is a cross-sectional diagram of a waterproof film covering a keyswitch of the keyboard according to an embodiment of the present invention.
Figure 5:
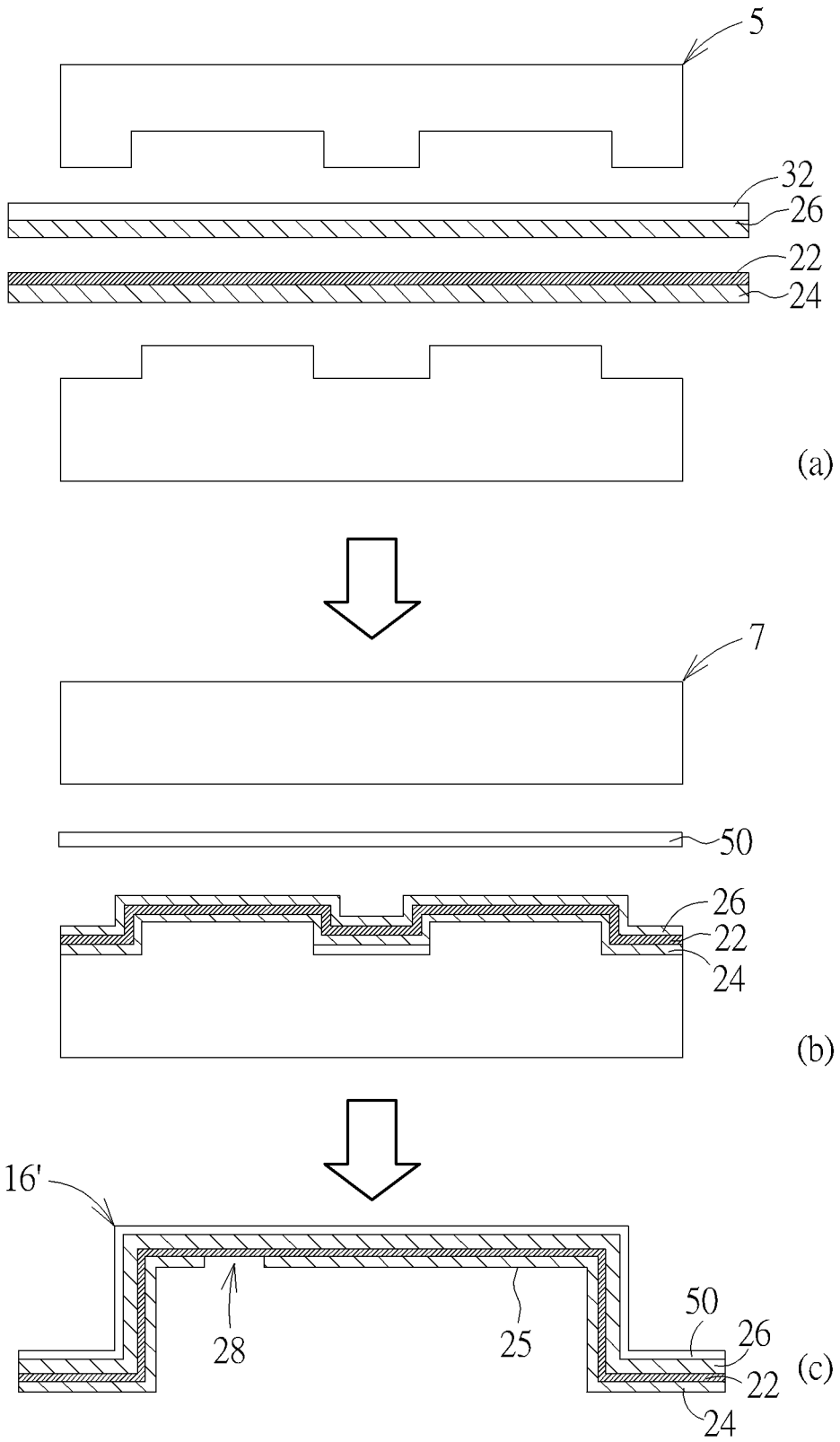
FIG. 5 is a process diagram of the waterproof film in FIG. 4.

It should be mentioned that the forming process of the waterproof film is not limited to the aforesaid embodiment. For example, please refer to FIG. 4 and FIG. 5. FIG. 4 is a cross-sectional diagram of a waterproof film 16' covering the keyswitch 14 of the keyboard 10 according to an embodiment of the present invention. FIG. 5 is a process diagram of the waterproof film 16' in FIG. 4. As shown in FIG. 4 and FIG. 5, the waterproof film 16' covers the keyswitch 14 and includes the film reinforcing layer 22, the light shielding layer 24, the texture layer 26, the pattern 28, and a transparent layer 50 (preferably made of silicone material, but not limited thereto). Components both mentioned in this embodiment and the aforesaid embodiments represent components with similar structures or functions, and the related description is omitted herein. First, the light shielding layer 24 can be coated under the film reinforcing layer 22, and then the film reinforcing layer 22 with the light shielding layer 24 coated thereon and the texture layer 26 attached to the release film 32 can be disposed in a mold 5 (as shown in FIG. 5(*a*)). The mold 5 can be utilized to perform a hot pressing process on the texture layer 26, the film reinforcing layer 22 and the light shielding layer 24, so that the texture layer 26 can be formed on the top surface 34 and the side surface 36 of the protruding structure 30 correspondingly after the release film 32 is peeled from the texture layer 26. Subsequently, a mold 7 can be utilized to perform a hot pressing process on the transparent layer 50 (as shown in FIG. 5(*b*)) for forming the transparent layer 50 on the texture layer 26 to generate the texture protection effect. Finally, the pattern 28 (e.g. a symbol, a number, etc.) can be formed on the light shielding layer 24 (as shown in FIG. 5(*c*)) by performing a pattern forming process (preferably a laser engraving process, but not limited thereto) on a bottom surface 25 of the light shielding layer 24, so as to form the waterproof film 16'. After the formed waterproof film 16' is attached to the keycap 18 (e.g. by glue, but not limited thereto), the connection process of the keyswitch 14 and the waterproof film 16' is completed (as shown in FIG. 4), so that the keyboard 10 can have a film protection function for generating the waterproof and dustproof effects.

Figure 6:
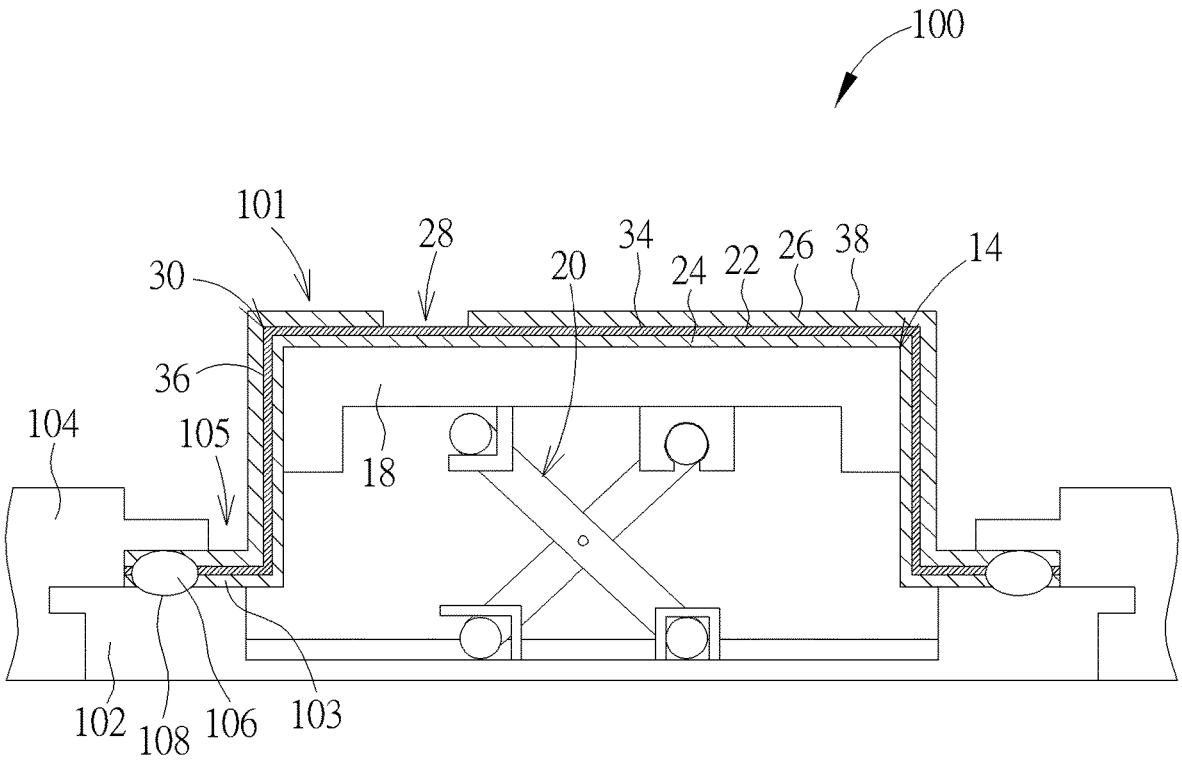
FIG. 6 is a partial cross-sectional diagram of a keyswitch according to another embodiment of the present invention.

Furthermore, the auxiliary waterproof design is not limited to the spacer layer design mentioned in the aforesaid embodiment. For example, please refer to FIG. 6, which is a partial cross-sectional diagram of a keyswitch 100 according to another embodiment of the present invention. As shown in FIG. 6, the keyboard 100 includes a waterproof film 101, a bottom board 102, the plurality of keyswitches 14 (only one shown in FIG. 6), and a keyboard frame 104. The keyswitches 14 is disposed on the bottom board 102 for a user to press to execute a desired input function. The waterproof film 101 covers the keyswitches 14 and includes the film reinforcing layer 22, the light shielding layer 24, the texture layer 26, the pattern 28, and a waterproof washer 106. Components both mentioned in this embodiment and the aforesaid embodiments represent components with similar structures or functions, and the related description is omitted herein. In this embodiment, the waterproof washer 106 is disposed around each keyswitch 14 and is disposed on the bottom board 102. The keyboard frame 104 is disposed on the bottom board 102 and has a plurality of hole structures 105 corresponding to the plurality of keyswitches 14, so as to make the plurality of hole structures 105 jacket the waterproof film 101. Accordingly, a bottom periphery 103 of the waterproof film 101 and the waterproof washer 106 can be sandwiched between the keyboard frame 104 and the bottom board 102, so that the waterproof washer 106 can prevent foreign bodies (e.g. water or dust) from entering the keyswitch 14 through a gap between waterproof film 101 and the bottom board 102 to cause damage of the keyswitch 14. Furthermore, in practical application, as shown in FIG. 6, a groove 108 is formed on the bottom board 102 for containing the waterproof washer 106 to make the waterproof washer 106 sandwiched between the keyboard frame 104 and the bottom board 102 more precisely and steadily, so as to improve the assembly convenience of the waterproof film 101.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A waterproof film covering a keyboard, the keyboard comprising a plurality of keyswitches, a bottom board and a keyboard frame, the plurality of keyswitches being disposed on the bottom board, the waterproof film comprising:

a film reinforcing layer;

a light shielding layer combined under the film reinforcing layer to form a plurality of protruding structures cooperatively with the film reinforcing layer by a hot pressing process, wherein the keyboard frame has a plurality of hole structures formed thereon corresponding to the plurality of keyswitches and is disposed on the bottom board to make each hole structure jacket the corresponding protruding structure;

a texture layer attached to a release film and then formed on a top surface and a side surface of each protruding structure after a hot pressing process is performed and the release film is then peeled;

a waterproof washer disposed around the plurality of keyswitches and disposed on the bottom board, a bottom periphery of the waterproof film and the waterproof washer being sandwiched between the keyboard frame and the bottom board; and a pattern formed on the texture layer or the light shielding layer.

2. The waterproof film of claim 1, wherein the pattern is formed on the light shielding layer by performing a pattern forming process on a bottom surface of the light shielding layer, and the waterproof film further comprises:

a transparent layer formed on the texture layer by a hot pressing process.

3. The waterproof film of claim 2, wherein the pattern forming process is a laser engraving process.

4. The waterproof film of claim 1, wherein the pattern is formed on the texture layer by performing a pattern forming process on a top surface of the texture layer.

5. The waterproof film of claim 4, wherein the pattern forming process is a laser engraving process.

6. The waterproof film of claim 1, wherein the film reinforcing layer is a fabric layer or a polymer film layer.

7. The waterproof film of claim 5, wherein the fabric layer has a denier from 15 to 100.

8. A keyboard comprising:

a bottom board;

a plurality of keyswitches disposed on the bottom board, each keyswitch comprising:

a keycap;

a keyboard frame having a plurality of hole structures formed thereon corresponding to the plurality of keyswitches; and a lifting mechanism disposed between the bottom board and the keycap, the keycap being movable upward and downward relative to the bottom board via the lifting mechanism; and a waterproof film covering the plurality of keyswitches, the waterproof film comprising:

a film reinforcing layer;

a light shielding layer combined under the film reinforcing layer to form a plurality of protruding structures cooperatively with the film reinforcing layer by a hot pressing process for covering each keycap, wherein the keyboard frame is disposed on the bottom board to make each hole structure jacket the corresponding protruding structure;

a texture layer attached to a release film and then formed on a top surface and a side surface of each protruding structure after a hot pressing process is performed and the release film is then peeled;

a waterproof washer disposed around the plurality of keyswitches and disposed on the bottom board, a bottom periphery of the waterproof film and the waterproof washer being sandwiched between the keyboard frame and the bottom board; and a pattern formed on the texture layer or the light shielding layer.

9. The keyboard of claim 8, wherein the pattern is formed on the light shielding layer by performing a pattern forming process on a bottom surface of the light shielding layer, and the waterproof film further comprises:

a transparent layer formed on the texture layer by a hot pressing process.

10. The keyboard of claim 9, wherein the pattern forming process is a laser engraving process.

11. The keyboard of claim 8, wherein the pattern is formed on the texture layer by performing a pattern forming process on a top surface of the texture layer.

12. The keyboard of claim 11, wherein the pattern forming process is a laser engraving process.

13. The keyboard of claim 8, wherein the film reinforcing layer is a fabric layer or a polymer film layer.

14. The keyboard of claim 13, wherein the fabric layer has a denier from 15 to 100.

15. The keyboard of claim 8, wherein a groove is formed on the bottom board for containing the waterproof washer.

* * * * *